US010307776B2

(12) United States Patent
Taberlet et al.

(10) Patent No.: US 10,307,776 B2
(45) Date of Patent: Jun. 4, 2019

(54) DEVICE WITH RIGID RECEPTACLE AND FLEXIBLE CYLINDRICAL POUCH FOR PACKAGING FLUIDS

(71) Applicant: LABLABO, Juvigny (FR)

(72) Inventors: Jean-Philippe Taberlet, Villard (FR); Alain Guy, Marigniers (FR); Patrice Puviland, Eteaux (FR)

(73) Assignee: LABLABO, Juvigny (FR)

( * ) Notice: Subject to any disclaimer, the term of this patent is extended or adjusted under 35 U.S.C. 154(b) by 204 days.

(21) Appl. No.: 14/901,318

(22) PCT Filed: Jun. 24, 2014

(86) PCT No.: PCT/FR2014/051571

§ 371 (c)(1),
(2) Date: Dec. 27, 2016

(87) PCT Pub. No.: WO2015/004360

PCT Pub. Date: Jan. 15, 2015

(65) Prior Publication Data

US 2017/0113236 A1 Apr. 27, 2017

(30) Foreign Application Priority Data

Jul. 8, 2013 (FR) ..... 13 56698

(51) Int. Cl.
*B05B 11/00* (2006.01)
*B65D 77/06* (2006.01)
(Continued)

(52) U.S. Cl.
CPC .... *B05B 11/00412* (2018.08); *B05B 11/0037* (2013.01); *B05B 11/3047* (2013.01);
(Continued)

(58) Field of Classification Search
CPC ..... B05B 11/0043; B05B 11/0037; B05B 11/3047; B05B 11/00412; B65D 77/06; B65D 83/38; B65D 83/0055
(Continued)

(56) References Cited

U.S. PATENT DOCUMENTS 3,020,688 A * 2/1962 Modderno ..... B65D 83/62 53/425
4,658,434 A * 4/1987 Murray ..... B32B 15/08 383/66
(Continued)

FOREIGN PATENT DOCUMENTS

WO 03011713 2/2003
WO 2012152267 11/2012

OTHER PUBLICATIONS

Search Report dated 2014.

*Primary Examiner* — Paul R Durand
*Assistant Examiner* — Andrew P Bainbridge
(74) *Attorney, Agent, or Firm* — IPSILON USA, LLP

(57) ABSTRACT

The invention relates to a device for packaging and dispensing a fluid product, having a leaktight flexible pouch (1) placed in a rigid bottle (10) and associated with a pump or a valve (13), this pouch having a cylindrical wall consisting of a sheet (2) rolled into a cylinder, one edge of which is fixed in a leaktight fashion to a flange forming a ring for fastening to the bottle and to the pump or the valve, this flange (4) consisting of a plastic material, the other edge of the said sheet is fixed in a leaktight fashion to a second flange forming the bottom of the pouch, this second flange (3) consisting of a plastic material, these flanges (3, 4) having a solid disk or a ring having a raised edge (3A, 4A) forming an annular lateral surface, to which the edge of the said sheet (2) forming the wall of the pouch is fixed, the said
(Continued)

sheet (2) of the cylindrical wall being a multilayer sheet having at least one inner film of plastic material.

According to the invention, the inner face of the said flanges carries a covering sheet (20A, 20B) entirely covering the inner face of the said flanges and also covering at least a part of the said inner annular lateral surface for fastening the edge of the said sheet (2) forming the wall of the pouch, and the said covering sheet (20A, 20B) has at least one film of the same plastic material as the said inner film of the said sheet of the cylindrical wall and a metal film, its plastic material film facing toward the inner face of the said sheet (2) constituting the cylindrical wall.

6 Claims, 3 Drawing Sheets

(51) Int. Cl.
*B65D 83/00* (2006.01)
*B65D 83/38* (2006.01)

(52) U.S. Cl.
CPC ..... *B65D 77/06* (2013.01); *B65D 83/0055* (2013.01); *B65D 83/38* (2013.01)

(58) Field of Classification Search
USPC ..... 222/92–107, 383.1–383.3, 386.5, 222/402.1–402.24
See application file for complete search history.

(56) References Cited

U.S. PATENT DOCUMENTS 4,842,165 A 6/1989 Van Coney
5,123,571 A * 6/1992 Rebeyrolle ..... B65D 83/62 220/23.83
5,292,034 A * 3/1994 Keller ..... B29C 43/18 222/107
5,647,510 A * 7/1997 Keller ..... B05C 17/00513 222/94
5,656,346 A * 8/1997 Hirt ..... B65D 35/08 206/277
6,073,805 A * 6/2000 Gueret ..... B05B 11/0013 222/105
6,189,744 B1 * 2/2001 Prince ..... B29C 65/3656 156/305
6,601,732 B1 * 8/2003 Rooney ..... B32B 27/06 222/107
6,722,531 B2 * 4/2004 Matsuo ..... B65D 35/12 215/42
7,770,762 B2 * 8/2010 Arghyris ..... B05B 11/0018 215/11.3
7,913,877 B2 * 3/2011 Neuhalfen ..... B65D 83/62 222/402.1
8,672,182 B2 * 3/2014 Bonet Pedrol ..... B65D 75/5883 222/107
8,906,187 B2 * 12/2014 Miller ..... B29C 69/005 156/211
9,327,899 B2 * 5/2016 Greenfield ..... B65D 83/62
2001/0050291 A1 * 12/2001 Jud ..... B65D 35/12 222/107
2005/0029291 A1 2/2005 Arghyris et al.
2005/0040181 A1 * 2/2005 Kurosawa ..... B65D 75/5883 222/92
2007/0108228 A1 * 5/2007 Kleyne ..... A61F 9/00 222/95
2013/0313283 A1 11/2013 Medico et al.
2015/0076164 A1 * 3/2015 De Cuyper ..... B65D 83/38 220/612
2015/0102064 A1 * 4/2015 Taberlet ..... B05B 11/3047 222/153.05
2015/0274373 A1 * 10/2015 Dierker ..... B65D 81/3233 206/524.6
2016/0046427 A1 * 2/2016 Bellmore ..... B65D 75/5877 383/42

* cited by examiner

DEVICE WITH RIGID RECEPTACLE AND FLEXIBLE CYLINDRICAL POUCH FOR PACKAGING FLUIDS

The invention relates to a device with a rigid outer bottle and a flexible cylindrical inner pouch for packaging fluids.

Such a device is described in the patent document WO 03/011713.

As represented in FIG. 1, this device for packaging and dispensing a liquid product has a leaktight flexible pouch 1 a placed in a rigid bottle 10, associated with a pump or a valve 13 and intended to be filled with the product to be packaged. This pouch 1 has a cylindrical wall consisting of at least one metal sheet or sheet of plastic material rolled into a cylinder, the edges of which are fixed in a leaktight fashion to two flanges 3, 4, of which one 3 forms the bottom of the pouch and the other 4 forms a ring for fastening to the bottle and to the pump or the valve.

Each flange 3, 4 has a solid disk or a ring having a raised edge 3A, 4A forming an annular lateral surface, to which the edge of the sheet of the cylindrical wall of the pouch 1 is fixed.

The pouch 1, filled with the product to be packaged, is introduced into the bottle 10, a radial edge 4B of the upper ring 4 being fixed by snap-fastening into a groove formed in the inner wall of the bottle 10. The pump 13, equipped with a push-button 14 and a nozzle 16, is mounted in a leaktight fashion on the upper ring 4.

Preferably, and as specified in the patent document WO 2010/125304, the cylindrical wall of the pouch 1 consists of a multilayer sheet, these layers being, from the outer layer to the inner layer, made of polyethylene, polyethylene terephthalate, aluminum and polyethylene.

Furthermore, the two flanges 3, 4 are generally made of plastic material, and preferably polyethylene.

Such polyethylene flanges pose the following technical problems.

They are transparent to light and permeable to oxygen. They can cause evaporation of volatile products, for example alcohol. Certain products may lead to phenomena of adsorption and/or absorption on the plastic material and become denatured thereby.

It could be envisaged to produce these flanges from barrier materials molded in bulk fashion, but such materials are relatively expensive. Furthermore, the use of such barrier materials requires, for the sheet forming the pouch, use of the same barrier material or a compatible material which can be fixed to it, preferably by welding. This would result in a significant increase in the manufacturing cost and complexity of the overall device.

Furthermore, patent document EP 0 354 137 describes a device for packaging and dispensing a liquid product, having a leaktight flexible pouch placed in a rigid bottle and associated with a pump or a valve, this pouch having a cylindrical wall consisting of a sheet rolled into a cylinder, one edge of which is fixed in a leaktight fashion to a flange forming a ring for fastening to the bottle and to the pump or the valve.

This ring consists of a plastic material, and its inner face may carry a washer with a barrier effect partially covering the inner face of the ring, and this washer may be made of a metal/plastic composite having a metal film.

This washer is welded to the face of the ring via a large face and is retained at its base by a small annular bead of plastic material.

Such a washer does not form an effective barrier, because it does not cover the inner face of the ring under this bead of plastic material retaining its base.

The invention improves the barrier effect of such a covering layer and provides a device which is easy to manufacture and an arrangement that can be fitted easily to current flanges consisting of a plastic material.

To this end, it provides a device for packaging and dispensing a fluid product, having a leaktight flexible pouch placed in a rigid bottle and associated with a pump or a valve, this pouch having a cylindrical wall consisting of a sheet rolled into a cylinder, one edge of which is fixed in a leaktight fashion to a flange forming a ring for fastening to the bottle and to the pump or the valve, this flange consisting of a plastic material, the other edge of the said sheet being fixed in a leaktight fashion to a second flange forming the bottom of the pouch, this second flange consisting of a plastic material, these flanges having a solid disk or a ring having a raised edge forming an annular lateral surface, to which the edge of the said sheet forming the wall of the pouch is fixed, the said sheet of the cylindrical wall being a multilayer sheet having at least one inner film of plastic material, characterized in that

- the inner face of the said flanges carries a covering sheet entirely covering the inner face of the said flanges and also covering at least a part of the said inner annular lateral surface for fastening the edge of the said sheet forming the wall of the pouch, and
- the said covering sheet has at least one film of the same plastic material as the said inner film of the said sheet of the cylindrical wall and a metal film, its plastic material film facing toward the inner face of the said sheet constituting the cylindrical wall.

The metal film of the covering sheet of each flange ensures a reliable barrier over the entire inner face of each flange in contact with the packaged product contained in the pouch. This embodiment ensures a total barrier on the entire inner face of the flange in contact with the packaged product contained in the pouch.

The covering sheet is therefore a multilayer sheet having at least one film of plastic material and a metal film. Since the plastic material of the inner film of the multilayer sheet of the cylindrical wall is identical to the one constituting the film of the covering layer which faces toward the inner face of the said cylindrical wall, fixing by welding between this wall and the coated flange can be carried out particularly effectively.

According to a preferred embodiment, the said covering sheet has at least one film of the same plastic material as the said flange and the said metal film, its plastic material film facing toward the inner face of the said flange.

Since this film of plastic material is made of the same plastic material as the flange and faces toward the inner face of the flange, fastening by welding of the covering sheet and the flange can be carried out particularly effectively.

Preferably, the said metal film(s) is (are) made of aluminum.

Furthermore, advantageously, the said plastic material is polyethylene.

Advantageously, the said covering sheet is a multilayer sheet, its layers being made of polyethylene, polyethylene terephthalate, aluminum and polyethylene.

Preferably, the said covering sheet is welded onto the inner face of the said sheet constituting the cylindrical wall.

The invention is described in more detail below with the aid of figures, which only represent a preferred embodiment of the invention.

Figure 1:
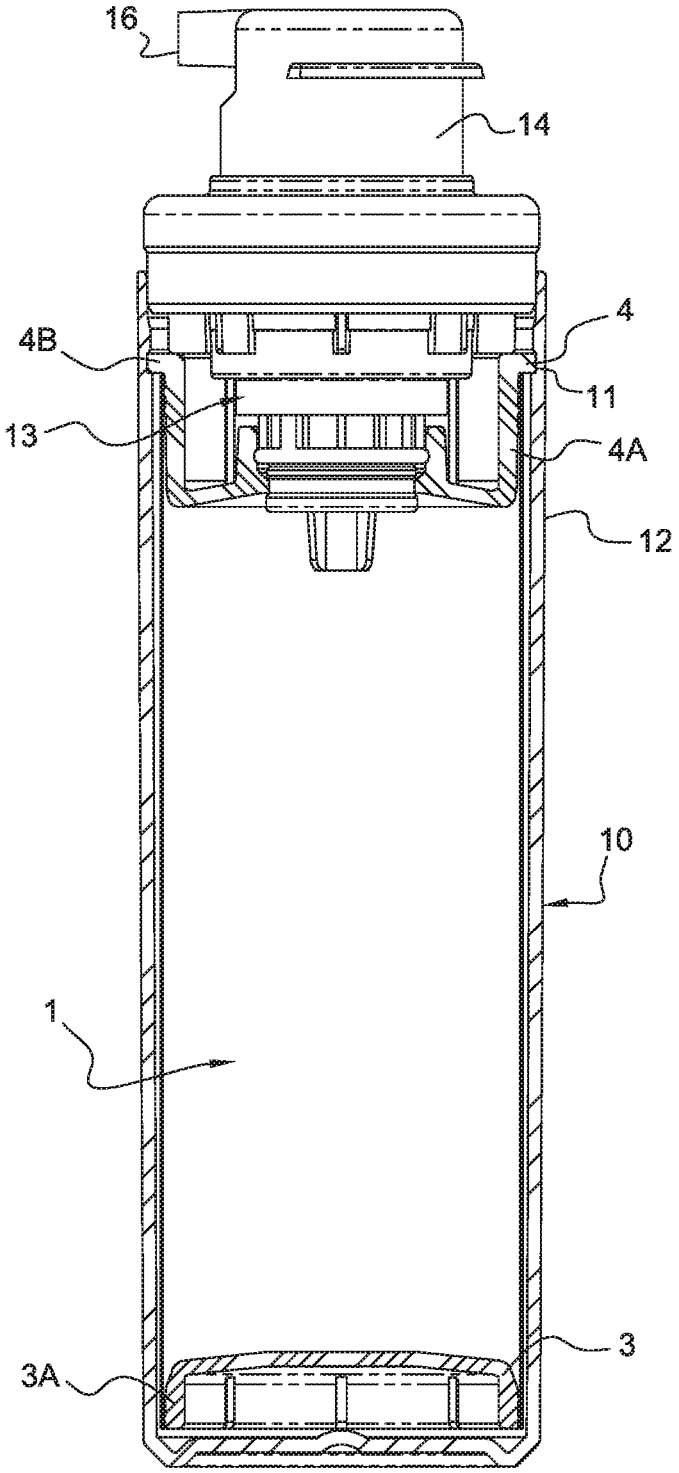
FIG. 1 is a view in vertical section of a device according to the prior art, and has already been described above.
Figure 2:
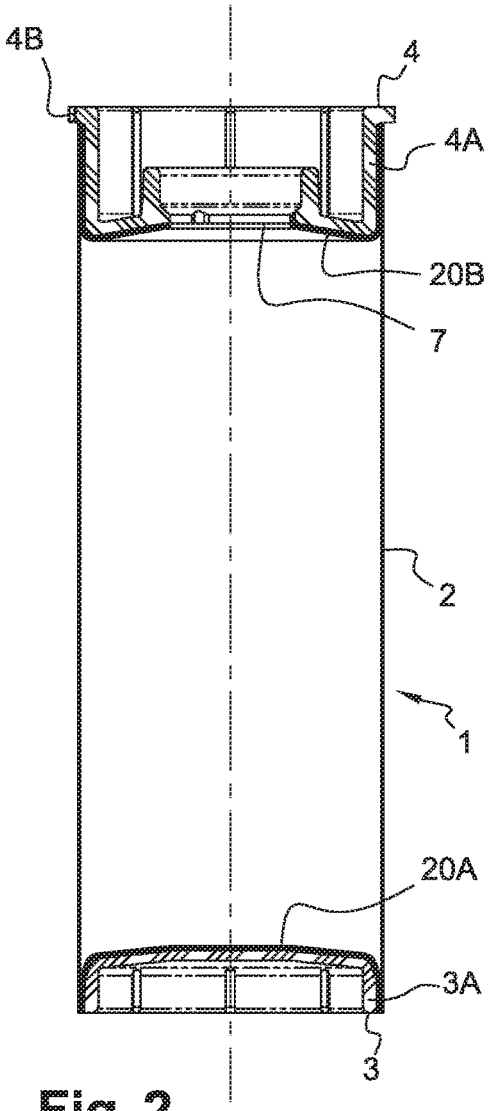
FIGS. 2 and 3 are views in section, and in perspective in the case of FIG. 3, of a pouch of a device according to the invention.
Figure 3:
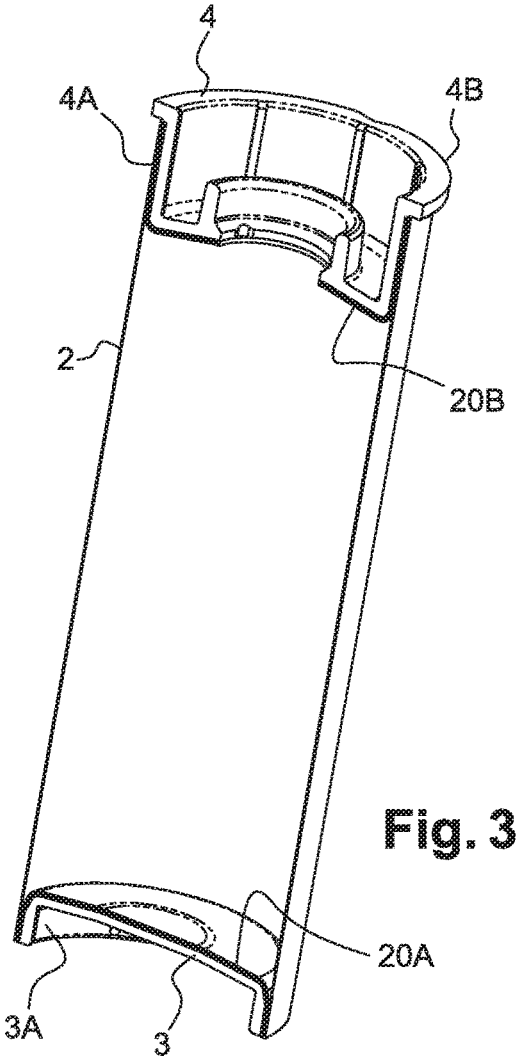

As represented in FIGS. 2 and 3, the invention relates to a device for packaging and dispensing a fluid product, having a leaktight flexible pouch 1 placed in a rigid bottle and associated with a pump or a valve, this pouch having a cylindrical wall consisting of a multilayer sheet 2 rolled into a cylinder, the edges of which are fixed in a leaktight fashion to two flanges 3, 4, of which one 3 forms the bottom of the pouch and the other 4 forms a ring for fastening to the bottle and to the pump or the valve.

Each flange 3, 4 has a solid disk or a ring having a raised edge 3A, 4A forming an annular lateral surface, to which the edge of the sheet of the cylindrical wall of the pouch is fixed.

The multilayer sheet 2 of the pouch 1 has at least one inner film of plastic material and a metal film, preferably a film of polyethylene and a film of aluminum. Preferably, it in fact consists of a multilayer sheet, these layers advantageously being, from the outer layer to the inner layer, made of polyethylene, polyethylene terephthalate, aluminum and polyethylene, in order to ensure optimal chemical and mechanical conditions.

The flanges 3, 4 consist of the same plastic material as the inner film of the sheet 2, and therefore preferably of polyethylene.

The inner face of at least one of the said flanges 3, 4 has a covering sheet 20A, 20B having a metal film and entirely covering the inner face of the corresponding flange.

To this end, the covering sheet 20A, 20B covers the inner face of the flange 3, 4 as well as at least a part of the inner annular lateral surface of its raised edge 3A, 4A.

The covering sheet 20A, 20B is identical to the multilayer sheet 2 constituting the cylindrical wall of the pouch 1 and is therefore a multilayer sheet, these layers being made of polyethylene, polyethylene terephthalate, aluminum and polyethylene.

The product to be packaged, intended to fill the pouch 1, therefore remains in contact with the polyethylene, but in a much smaller proportion by thickness, limiting any phenomenon of absorption and/or adsorption. Specifically, if the thickness of a flange 3, 4 is of the order of from to 1.5 mm, that of the film of polyethylene of the covering layer 20A, 20B is of the order of 0.1 mm.

Furthermore, since the covering sheet 20A, 20B has a film of polyethylene on its two faces, fastening by welding of the covering sheet and the flange is easy and, once covered, the flange has a film of polyethylene on the outer annular lateral surface of its raised edge, which allows easy fastening by welding of the sheet 2 of the cylindrical wall of the pouch 1, which itself has a film of polyethylene directed toward the flange.

Figure 4:
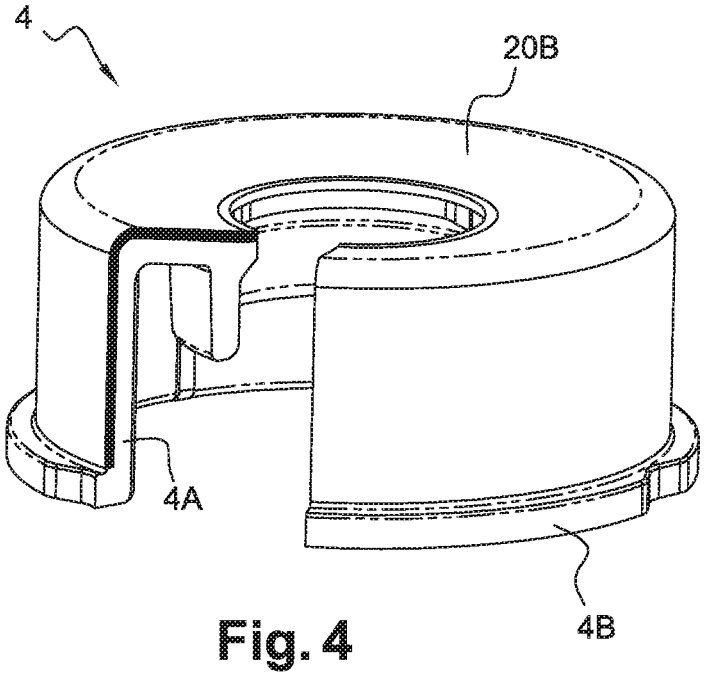
FIGS. 4 and 5 are views in perspective of the flanges according to the invention, cut away in order to allow their cross section to be seen.
Figure 5:
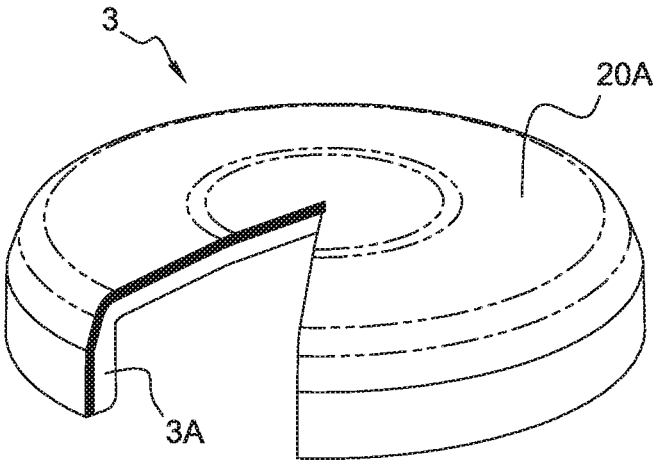

Even though, in the scope of the invention, just one of the flanges 3, 4 may be equipped with such a covering sheet while providing an improvement in the conditions of evaporation, adsorption and/or absorption, optimally both flanges are made of plastic material, preferably polyethylene, and the inner face of the two flanges 3, 4 of the pouch 1 has such a covering sheet 20A, 20B, as represented in FIGS. 4 and 5. As can be seen in these figures, the covering sheet 20A, 20B preferably covers the entire inner annular lateral surface of the flanges 3, 4.

The process of fitting the covering sheet 20A, 20B on the corresponding flange 3, 4 is greatly facilitated by the fact that the plastic material constituting the flange and the film of plastic material of the covering sheet 20A, 20B is the same, and preferably polyethylene.

The covering sheet 20A, 20B is overmolded on the inner surface of the flange by the method known as "In-mold labeling" or "IML". This method ensures optimal integration of the covering sheet over the entire inner face of the flange 3, 4, as well as over the annular lateral surface 3A, 4A. Further to the fact that this method can be fully robotized, it ensures perfect positioning of the covering sheet and therefore perfect and full covering of the inner face of each flange.

The invention claimed is:

1. Device for packaging and dispensing a fluid product comprising:

a leaktight flexible pouch placed in a rigid bottle; and a dispensing element, where said dispensing element has a pump or a valve, said pouch having a cylindrical wall formed from a multi-layer pouch sheet rolled into a cylinder, a first top pouch edge of said dispensing element is fixed in a leaktight fashion to a first flange forming a ring for fastening to the bottle and to the dispensing element, said first flange formed from a plastic material, a second bottom pouch edge of said multi-layer pouch sheet being fixed in a leaktight fashion to a second flange forming the bottom of the pouch, said second flange formed from a plastic material, said first and second flanges having a solid disk or a ring having a raised annular lateral surface, to which the bottom pouch edge of said multi-layer pouch sheet forming the wall of the pouch is fixed, said multi-layer pouch sheet of the cylindrical wall having at least one inner layer of plastic material, wherein the inner faces of said first and second flanges each carry a multi-layer covering sheet entirely covering their inner faces and also covering at least a part of said inner annular lateral surface for fastening the first top and second bottom edges of said multi-layer pouch sheet forming the wall of the pouch, and wherein said multi-layer covering sheet has at least one layer of the same plastic material as said inner layer of said multi-layer pouch sheet of the cylindrical wall, said multi-layer pouch sheet and said multi-layer covering sheet both having an outer layer of a metal, said plastic inner layer of said multi-layer covering sheet facing toward the inner face of said multi-layer pouch sheet.

2. Device according to claim 1, wherein said multi-layer covering sheet has outer metal layer with said inner plastic layer being of the same plastic material as said flanges, wherein said plastic material inner layer of said multi-layer covering sheet facing inward towards said pouch.

3. Device according to claim 1, wherein said metal layers are made of aluminum.

4. Device according to claim 1, wherein said plastic material is polyethylene.

5. Device according to claim 1, wherein said layers of either one of said multi-layer covering sheet or said multi layer pouch sheet are made of polyethylene, polyethylene terephthalate, aluminum and polyethylene.

6. Device according to claim 1, wherein said multi-layer covering sheet is welded onto the inner face of said multi-layer pouch sheet.

* * * * *